US010807771B2

(12) United States Patent
Lambert et al.

(10) Patent No.: US 10,807,771 B2
(45) Date of Patent: Oct. 20, 2020

(54) BAG FOR TRANSFERRING AND PACKAGING COMPONENTS OF A CONTAINED ENCLOSURE

(71) Applicant: Lourd'Innov, Lourdes (FR)

(72) Inventors: Cédric Lambert, Neuilh (FR); Stéphanie Armau, Ossun (FR)

(73) Assignee: Lourde'Innov (FR)

( * ) Notice: Subject to any disclaimer, the term of this patent is extended or adjusted under 35 U.S.C. 154(b) by 321 days.

(21) Appl. No.: 15/562,128

(22) PCT Filed: Mar. 30, 2016

(86) PCT No.: PCT/EP2016/056945

§ 371 (c)(1),
(2) Date: Sep. 27, 2017

(87) PCT Pub. No.: WO2016/156419

PCT Pub. Date: Oct. 6, 2016

(65) Prior Publication Data

US 2018/0079558 A1 Mar. 22, 2018

(30) Foreign Application Priority Data

Mar. 30, 2015 (FR) ..... 15 52693

(51) Int. Cl.
*B65B 31/00* (2006.01)
*B65D 33/18* (2006.01)
(Continued)

(52) U.S. Cl.
CPC ..... *B65D 33/18* (2013.01); *B65B 9/15* (2013.01); *B65D 33/24* (2013.01); *G21F 5/06* (2013.01);
(Continued)

(58) Field of Classification Search
CPC ..... B65B 9/15; B65B 31/00
(Continued)

(56) References Cited

U.S. PATENT DOCUMENTS 4,489,538 A 12/1984 Brak et al.
5,853,207 A 12/1998 Saint Martin et al.
(Continued)

FOREIGN PATENT DOCUMENTS

DE 202013105859 U1 1/2014
EP 2091051 A1 8/2009
(Continued)

OTHER PUBLICATIONS

International Search Report for Application No. PCT/EP2016/056945 dated May 9, 2016.

*Primary Examiner* — Chelsea E Stinson
(74) *Attorney, Agent, or Firm* — Lerner, David, Littenberg, Krumholz & Mentlik, LLP

(57) ABSTRACT

The invention relates to a bag for sealingly packaging components, which includes: a flexible body (10) defining an inside space, including a communication opening and a side wall including a plurality of strips folded against one another; and a joining device which can selectively open or close the communication opening, and is shaped so as to be mounted on an enclosure to allow sealed communication between an inner cavity of the enclosure and the inside space of the bag, the bag being characterized in that at least one fold made up of two strips opposite one another is detachably connected to at least one other fold.

9 Claims, 7 Drawing Sheets

(51) Int. Cl.

| | |
|---|---|
| ***G21F 7/005*** | (2006.01) |
| ***G21F 5/06*** | (2006.01) |
| ***B65B 9/15*** | (2006.01) |
| ***B65D 33/24*** | (2006.01) |
| *B65B 39/06* | (2006.01) |
| *B65B 7/02* | (2006.01) |
| *B65B 51/10* | (2006.01) |

(52) U.S. Cl.
CPC ..... *G21F 7/005* (2013.01); *B65B 7/02* (2013.01); *B65B 31/00* (2013.01); *B65B 39/06* (2013.01); *B65B 51/10* (2013.01)

(58) Field of Classification Search
USPC ..... 53/469
See application file for complete search history.

(56) References Cited

U.S. PATENT DOCUMENTS

| | | | | |
|---|---|---|---|---|
| 7,712,962 | B1 * | 5/2010 | Reuhs | B65D 31/04 383/105 |
| 2005/0139508 | A1 | 6/2005 | Su | |
| 2011/0142574 | A1 | 6/2011 | Schnyder | |
| 2013/0108753 | A1 | 5/2013 | Thomas | |
| 2014/0270580 | A1 * | 9/2014 | Thomas, Jr. | B65B 3/17 383/26 |

FOREIGN PATENT DOCUMENTS

| | | | | |
|---|---|---|---|---|
| EP | 2721289 | A1 | 4/2014 | |
| FR | 2721289 | A1 | 12/1995 | |
| WO | 2009153676 | A1 | 12/2009 | |
| WO | 2010145042 | A1 | 12/2010 | |
| WO | WO-2010145042 | A1 * | 12/2010 | B65B 9/15 |
| WO | 2011023906 | A1 | 3/2011 | |

* cited by examiner

BAG FOR TRANSFERRING AND PACKAGING COMPONENTS OF A CONTAINED ENCLOSURE

CROSS REFERENCE TO RELATED APPLICATIONS

The present application is a national phase entry under 35 U.S.C. § 371 of International Application No. PCT/EP2016/056945 filed Mar. 30, 2016, which claims priority from French Patent Application No. 1552693 filed Mar. 30, 2015, the disclosures of which are incorporated herein by reference.

FIELD OF THE INVENTION

The invention relates to a bag for sealingly packaging components, and a packaging method for components with said bag. The invention applies in particular to packaging components transferred from a contained and controlled area such as a clean room or an isolator. These components can be sterile and/or contaminating.

PRIOR ART

The activity in contained areas such as isolators or clean rooms requires controlling the intake and removals of components in these areas, without loss of confinement, to avoid any contact between the controlled atmosphere of the contained area and the outside atmosphere.

In particular, for the removal of components from contained areas, it is known, so as to limit the number of manipulations and the operational cost of such transfers, to use a single packaging for a series of transfers, in other words to remove components from the enclosure repeatedly.

This packaging is typically a flexible bag of considerable length, the mouth whereof is positioned in communication with the interior of the enclosure. To accomplish this communication without loss of confinement or contamination of the contained atmosphere by the outer atmosphere and vice versa, the flexible bag and the enclosure are advantageously provide with a joining system such as that described in document WO 2011/023906. Other possible joining system are described for example in documents FR 2 721 289 and EP 2 091 051.

As can be seen in FIG. 1*a*, once the bag S is put into communication with the interior of the enclosure E, components C can be transferred from the interior of the enclosure to the interior of the bag. The bag is then typically heat-welded, as illustrated in FIG. 1*b*, to isolate the components in a closed compartment and detach this compartment from the rest of the bag.

In FIG. 1*c*, an additional length of bag can then be unfolded to be subsequently filled with other components.

In order to store the unused length of the bag ergonomically while facilitating its handling, the bag is typically mounted on a rigid tube T. The mounting is most often accomplished manually by progressively putting the entire length of the bag onto the tube. This is work requiring considerable time and which can also cause problems of cleaning and sterilization of the tube between the installation of two successive bags.

In certain other cases the bag is delivered already premounted on a rigid tube, this tube is generally situated inside the pleated area, which requires discarding the tube from the contained area after the bag has been used completely.

In addition, such a tube has considerable bulk in any case.

Solutions allowing the use of a rigid tube to be dispensed with have already been proposed such as in document WO 2009/153676 for example. This solution provides for folding back a length of bag in a cavity of a circular box. This system, however, is also very bulky and cannot be used in a narrow area.

There exists therefore a need for a less bulky packaging bag, easy to use and less constraining from the ergonomic standpoint.

PRESENTATION OF THE INVENTION

The invention has as its goal to propose a packaging system for components from a contained enclosure not having the disadvantages of the prior art. In particular, one goal of the invention is to propose a packaging system less bulky than the prior art, and not having cleaning and sterilization problems.

Another goal of the invention is to propose a packaging system generating less waste than the ready-to-use bags mounted on tubes.

In this regard, the invention has as its object a bag for sealably packaging components, comprising:

- a flexible body defining an inside space, comprising:
  - a communication opening, and
  - a lateral wall comprising a plurality of strips folded back against one another, and
- a joining device which can selectively close or open the communication opening, and being formed to be mounted on an enclosure to allow sealed communication between an inside cavity of the enclosure and the inside space of the bag, the bag being characterized in that at least one fold formed by two strips opposite one another is detachably connected to at least one other fold.

Advantageously, but optionally, the bag according to the invention can also comprise at least one of the following features:

- At least one strip of a fold is detachably connected to at least one strip located opposite by a peelable weld of these strips.
- At least one fold includes at least one detachable connector to at least one other fold.
- The detachable connector comprises at least one yoke, and the bag also comprises at least one member for connecting the yokes corresponding to one or more folds.
- The connection member includes a through opening created in each yoke, and at least one link formed to extend through the openings of the yokes.
- Each yoke is permanently attached to the wall or integrated with the wall, and comprises at least one cutting line extending from the through opening to one edge of the yoke.
- The yoke is attached removably to the wall by being peelably welded to the wall, or by comprising a means of temporary attachment to the wall suitable for cooperating with a corresponding attachment means of the wall, the attachment means comprising one of the following group:
  - ratcheting device comprising two components arranged respectively on the yoke and the wall, opposite one another,
  - hook-and-pile type connection device arranged on the yoke and the wall, opposite one another,
  - adhesive areas of the yoke and/or of the wall, opposite one another.

The yoke comprises a portion permanently attached to the wall or integrated therewith, a detachable portion attached to the connection member, and a cutting line extending between the two portions.

At least one fold comprises a connector suitable for cooperating with a connector of an adjacent fold.

The connectors of two adjacent folds comprise a ratcheting device comprising two components arranged respectively on the outside surface of two strips, opposite one another.

The connectors of two adjacent folds comprise a hook-and-pile type connection device arranged on areas of the outside surface of two strips, opposite one another.

The connectors of two adjacent folds comprise adhesive strips applied to the outside surface of two strips, opposite one another.

The bag also comprises a yoke applied to a flap of the lateral wall opposite the communication opening, the yoke including at least one protruding portion to allow it to be gripped.

The invention also has as its object a packaging method for at least one component contained in a controlled-environment enclosure, comprising the steps consisting of:

bringing a bag according to the foregoing description into sealed communication with the enclosure, bringing at least one component from the interior of the enclosure to the interior of the bag, closing a compartment of the bag comprising components, and detaching the first fold of the bag before the bottom from the other folds, and unfolding said fold.

Advantageously, but optionally, the closure of the compartment is implemented by heat-welding the wall.

The folds of the bag are connected detachably with at least one other fold, which allows holding the folds of the bag together and keeping it compact. Moreover, the bag can be unfolded fold by fold thanks to this detachable connection, so as to be able to deploy an additional strip of the flexible body and thus obtain a new space which can be filled with components, without requiring a rigid structure to support it.

In addition, the entire length of the bag can thus be progressively used for packaging components, which reduces the quantity of waste generated by the use of such a bag.

DESCRIPTION OF THE FIGURES

Other features, goals and advantages of the invention will be revealed by the description that follows, which is purely illustrative and not limiting, and which must be read with reference to the appended drawings, wherein.

DETAILED DESCRIPTION OF AT LEAST ONE EMBODIMENT OF THE INVENTION

Figure 1A:
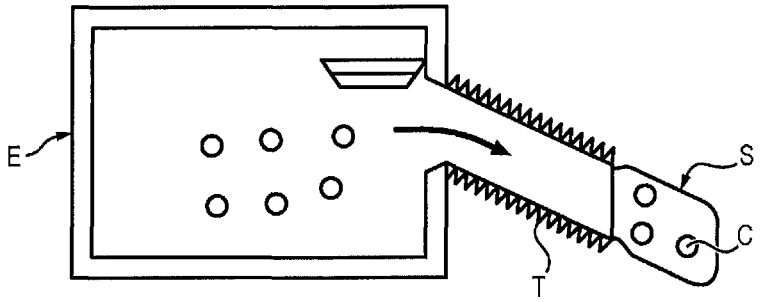
FIGS. 1*a* to 1*c*, already described, show schematically the filling of a packaging bag using components stored in a controlled atmosphere according to the prior art.
Figure 1B:
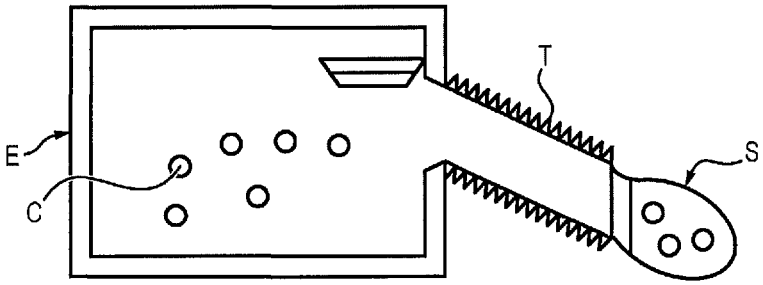
Figure 1C:
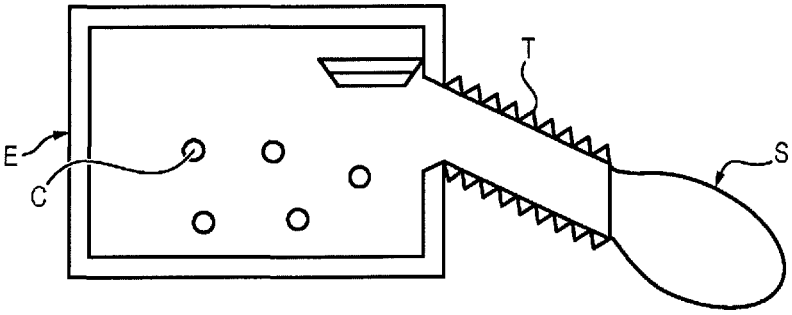
Figure 2:
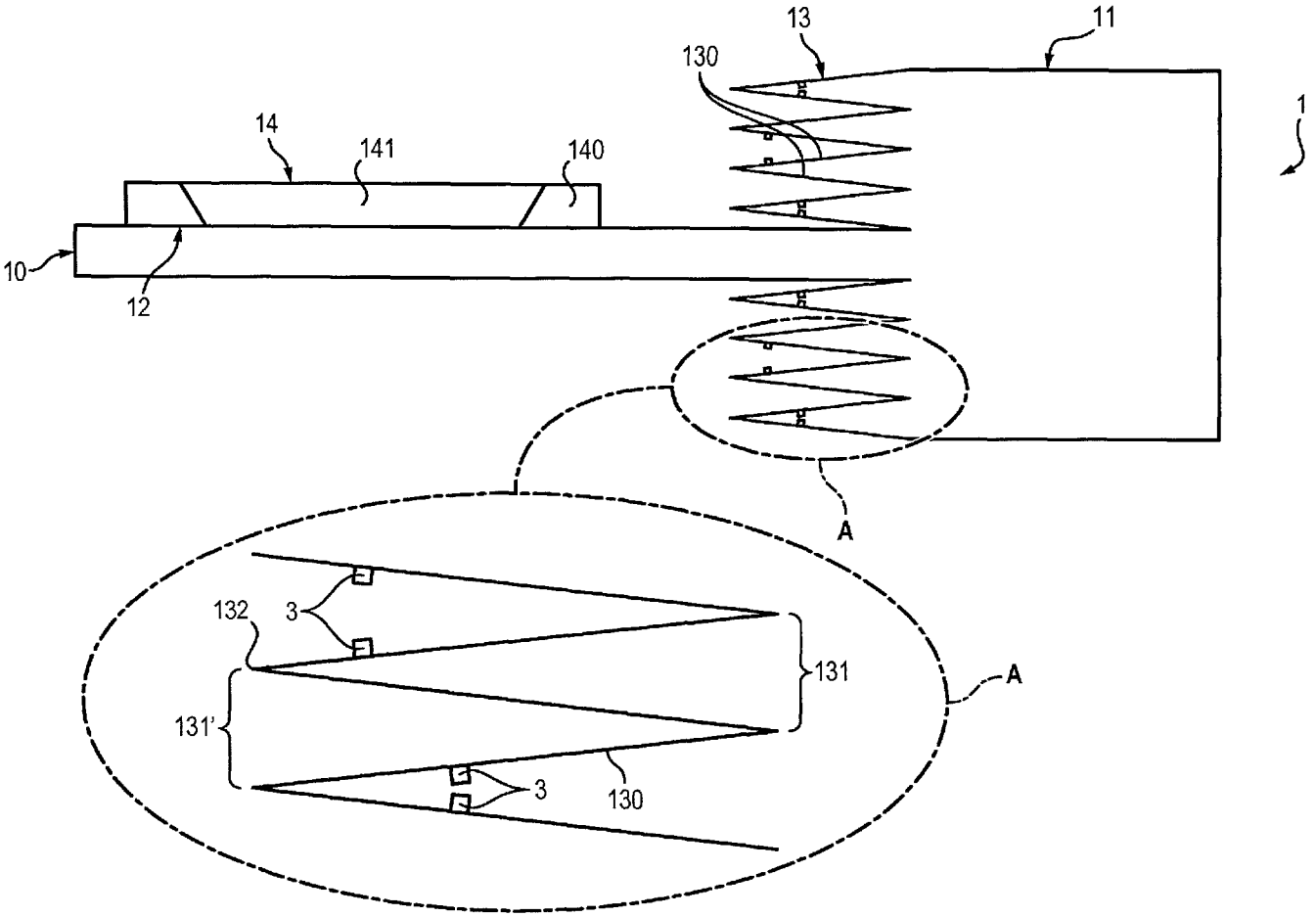
FIG. 2 shows schematically a complete view and a detail of a bag conforming to an embodiment of the invention.

With reference to FIG. 2, a bag 1 for packaging components derived from a contained area. The contained area, shown in FIGS. 9*a* to 9*d*, is an enclosure 2 containing an inside space 20, the atmosphere whereof must not communicate with the atmosphere outside the enclosure.

The contained area can be an isolator, a clean room, etc. for example.

The bag 1 comprises a flexible body 10, typically made of a plastic material such as polyethylene or polyurethane. The flexible body comprises a mouth or communication opening 12, and a lateral wall 13, also flexible. The lateral wall 13 is closed at a bottom 11. The space defined by the flexible body 10, extending between the bottom and the communication opening 12, is an inside space of the bag.

The bag 1 also comprises a device 14 for joining with the enclosure 2. The joining device 14 advantageously comprises a rigid frame 140 mounted around the communication opening 12, and a door 141 blocking the frame 140, the door 141 being movable with respect to the frame to be able to selectively close or open the communication opening, thus allowing passage of the component toward the interior of the bag.

Optionally, the joining device 14 can comprise a sleeve (not shown) connecting the rigid frame 140 to the flexible body 10.

Advantageously, the enclosure 2 similarly comprises a frame 21 and a door 22 movable with respect to the frame 21 to selectively open or close access to the inside space of the enclosure 20.

In order not to contaminate the atmosphere of the inside space of the enclosure with the outside atmosphere, and vice versa, the joining device 14 of the bag 1 on the one hand, and the frame 21 and the door 22 of the enclosure on the other hand, are advantageously designed in conformity with document WO 2011/023906 (or to other similar means already cited). As a consequence, the opening of the enclosure occurs only concomitantly with the opening of the bag, so as to form a sealed area formed by the inside space 20 of the enclosure and that of the bag 1, which eliminates the risks of cross-contamination between the outside atmosphere and the interior atmosphere. Moreover, the outside surface of the joining device 14 is in sealed contact with that of the frame 21 and of the door, thus allowing these surfaces to be isolated from the atmosphere found in the interior of the enclosure 2 and of the bag 1.

The bag 1 typically has a main longitudinal dimension longer than its transverse dimension. The excess length in the longitudinal direction constitutes as much potential volume available for progressively packaging components as the bag is used.

As can be seen in FIG. 2, a portion of the lateral wall 13 arranged between the bottom 11 and the mouth 12 is folded back in an accordion shape to compactly store this excess length. The accordion folding is accomplished by folding back the strips 130 of the lateral wall against one another in parallel and alternate folds.

Advantageously, the strips 130 are all of the same length. Thus the unfolding of a fold always corresponds to the addition of an identical length to the bag 1, corresponding to twice the length of a strip 130.

Hereafter a portion of the lateral wall formed from two consecutive strips 130 opposite one another is called a fold 131, and the intersection line of the two strips is called a fold line 132.

It is observed, as can be seen in the close-up portion of FIG. 2, that depending to the accordion folding, the folds can be numbered in several fashions: either a fold 131 is formed with two strips 130 opposite one another at their inner face, or a fold 131' is formed of two strips opposite one another at their outside face.

In this particular case, what follows applies in the same manner two both definitions of a fold. Only reference symbol 131 is therefore retained for designating a fold according to one or the other definition. Nevertheless, for the sake of consistency, when several folds are designated for a single embodiment, the same definition must be applied to all the folds.

In order to maintain a small bulk for the bag, while facilitating its use, the bag 1 comprises a reinforcement of at least one fold, and preferably of several or the totality of the folds, to maintain all the strips 130 folded over each other.

As described in more detail hereafter, this reinforcement is made by connecting temporarily at least one fold 131 with at least one other fold.

Preferably, each fold is connected to at least one other fold. For example, each fold can be connected to at least one adjacent fold, or to two folds next to which it is arranged, if applicable. According to one embodiment described in more detail hereafter with reference to FIGS. 3*a* to 6, each fold can also be connected to all the other folds.

The different variant embodiments of possible connections will now be described.

Connection by Peelable Weld

Figure 3B:
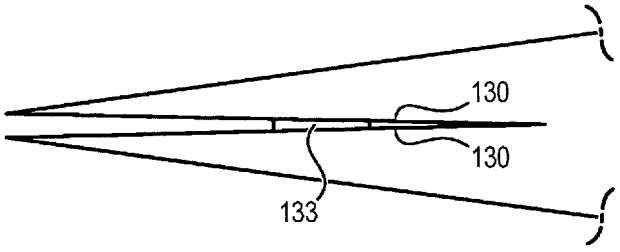
FIGS. 3*a* and 3*b* illustrate schematically a first embodiment of a bag.
Figure 3A:
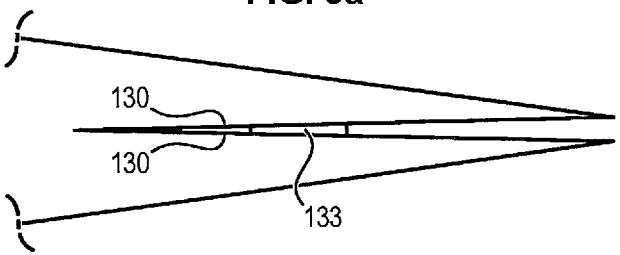

According to a first embodiment, shown in FIGS. 3*a* and 3*b*, at least two consecutive strips 130 can be welded together using a peelable weld 133, that is an area where the strips are welded in a detachable manner.

In FIG. 3*a*, the strips welded together are opposite at their inner face.

In FIG. 3*b*, the strips welded together are opposite one another at their outside surface.

It is possible to accomplish simultaneously a peelable weld of all the folds, in which case each fold is connected to all the other folds.

Connection by a Dedicated Connector

According to a second embodiment shown in FIGS. 4*a* to 7*c*, the bag comprises, at one fold 131 at least, at least one connector 3 to another fold 131. Preferably, so as not to degrade the seal of the bag, the connector does not run through a wall of the bag designed to be in contact with components.

Advantageously, each fold 131 is connected to at least one other fold, preferably to at least one adjacent fold, by a connector 3.

Thus the folds are all held connected to one another, without a bulky holding means at the exterior or at the interior of the bag. Moreover, in order to allow progressive deployment of the bag fold by fold, all the connectors 3 are detachable, that is they allow temporary joining of one fold with the adjacent fold(s).

The connectors 3 can be subject to several embodiments.

Yokes and Connection Member

One preferred embodiment of a connector 3 comprises a yoke 30 applied to the outside surface of the fold 131. This embodiment is illustrated in FIGS. 4*a* to 6.

Figure 5A:
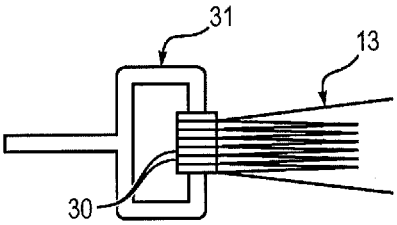
FIGS. 5*a* to 5*c* illustrate variants of another embodiment of a bag, FIG. 6 illustrate another embodiment of a bag.
Figure 5B:
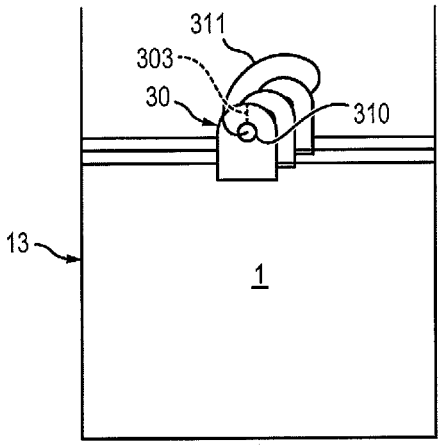
Figure 5C:
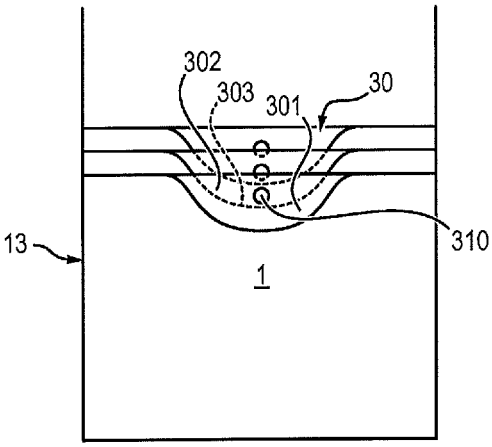

Alternatively, as can be seen in FIG. 5*c*, the yoke 30 can be directly integrated with the fold. To accomplish this, a portion of each strip forming the fold is welded to the opposite portion of the other strip. This weld is a permanent weld. In this case, the surface covered by the yoke 30 remains folded when the fold is detached from the other folds, which reduces slightly the inside space of the fold. On the other hand, it eliminates the necessity of applying yokes of additional material on the fold.

In addition, the bag 1 comprises a member 31 connecting each yoke to the other yokes, to hold all the folds connected together. Moreover, each fold is thus held connected to the other folds by a structure independent of the other folds, formed by the connection member 31, which allows forming a fixed retention point of the other folds when a fold is pulled to detach it from the others.

The connection member 31 can for example comprise a clamp holding the yokes together by clamping, or a hook extending through the yokes.

Alternatively and preferably, the connection member 31 comprises a through opening 310 made in the thickness of each yoke. The through opening is arranged only in the thickness of the yoke 30, but not in the wall 13 of the bag, so as not to put into communication the inside space of the bag with the outside atmosphere. In the case of FIG. 5*c*, the opening is arranged in the welded portion of the fold, so that the opening passes through the wall 13 from side to side without causing communication between the inside space of the bag and the outside. The connection member 31 also comprises at least one link 311 the diameter whereof is less than that of the openings of the yokes to be able to run into the yokes and thus to connect together several yokes, while at the same time being thus connected to each of the yokes.

Of course, the variants of connection members 31 are combinable with the variant embodiments of the yokes.

As described in more detail hereafter, the detachable character of the connection between two folds can be obtained in several manners:

Either the yoke can be detached from the wall 13 of the bag,

Or the yoke can be detached from the connection member 31,

Or else the yoke can be separated into a portion attached to the wall 13 of the bag, and a portion attached to the connection member.

Figure 4B:
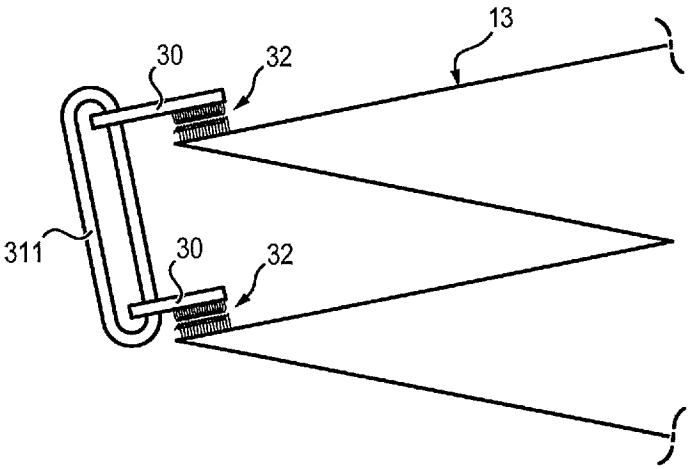
FIGS. 4*a* and 4*b* illustrate variants of another embodiment of a bag.
Figure 4A:
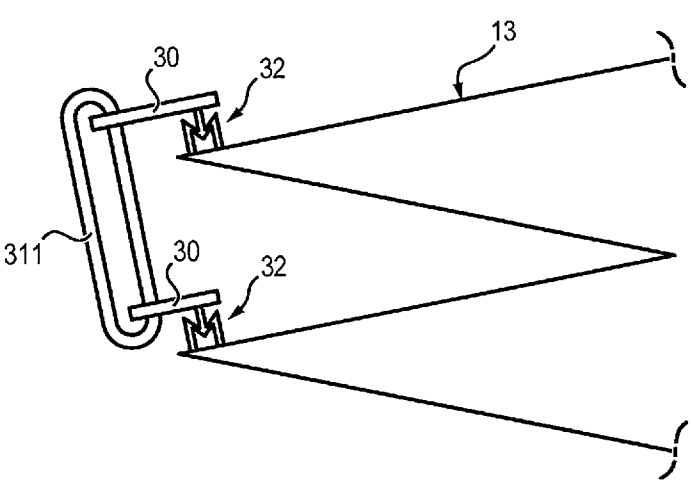

In the first place, a detachable yoke 30 of the wall 13 of the bag can be implemented in different manners, certain of which are illustrated in FIGS. 4*a* and 4*b*.

In the case where the yokes 30 are applied to the wall 13, each yoke 30 can for example be welded peelably to the wall 13, that is it can be detached from the wall by mere tension exerted thereon.

As a variant, each yoke 30 can be applied temporarily to the wall 13 by a detachable adhesive strip, or by a mechanical means which can be detached by applying tension. Typically, the means described hereafter with reference to FIGS. 7*a*, 7*b* and 7*c* (hook-and-pile, ratcheting device or pushbutton, etc.) can be applied to the attachment of the on the wall 13. In this case, a yoke 30 includes a first connection element and the wall 13 includes a second connection element cooperating with the first element.

An embodiment is shown in FIG. 4*a* wherein the yokes are applied removably to the wall by a ratcheting device 32, and in FIG. 4*b* an embodiment wherein the yokes are applied removably to the wall by strips of the hook-and-pile type 32 applied to the wall 13 and to the yoke, opposite one another.

Secondly, if the detachable connection is made by separating a yoke 30 from the connection member 31, the yoke is then preferably attached permanently to the wall 13 of the bag. This is the case of the yoke formed by welding the two portions of the strips of a fold, in FIG. 5*c*.

Alternatively, in the case where the yokes 30 are applied, they can be welded, (not peelably), to the wall of the bag.

The detachment of a yoke from the connection member 31 can be subject to several variants.

For example, in FIG. 5*a*, in the case where the connection member 31 is a clamp retaining the yokes 30 firmly attached, the clamping of the clamp can be adjusted to allow one yoke to be disengaged from the clamp by pulling on the wall 13.

Alternatively, in FIG. 5*b*, in the case where the means of attachment comprises through openings and a link 311, each yoke 30 can include one or more cutting lines 303, extending from the edge of the through opening 310 to the edge of the yoke 30. A cutting line is a weakened line which can open when tension is exerted on both sides of the line. This is for example a line along which micro-perforations are made to form a cutting starter. By pulling on the fold it is then possible to tear the cutting line and thus open the opening 310 to separate the yoke 30 from the link 311.

Finally, lastly, in the case where the yoke is detached into one portion 301 attached to the wall and one portion 302 attached to the connection member, this detachment can be by tearing the yoke or a separation along one (or more) cutting lines 303 made previously. This is applicable whether the yoke is applied or formed integrally with the bag.

Figure 6:
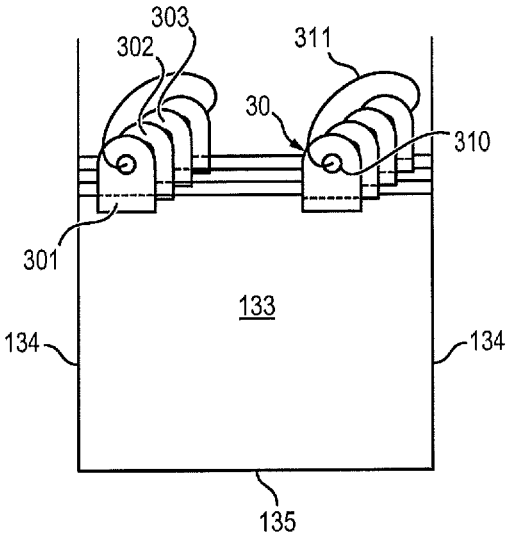

For example, as shown in FIG. 6, whether the connection member 31 comprises a clamp or a link running in the openings, a cutting line 303 can be provided between a first portion 301 permanently attached to the wall 13, for example by being welded (not peelably) to it, glued or attached by any other means know to a Person Skilled in the Art, and a second portion 302 separable from the first.

In FIG. 5*c*, a cutting line 303 is also shown allowing a portion 302 of the yoke attached to the connection member to be separated from a portion 301. As the portion 301 is part of the strips sewn together, it closes the bag even after the detachment of the portion 302 and thus preserves its seal.

The yokes of the folds connected to a connection member and/or interconnected by said member, allow the folds of the bag to be gathered in a compact manner, for example in a pre-established configuration. When an additional length of bag is desired, it is sufficient to pull on the first fold or on the bottom of the bag 11 to separate all or part of the corresponding yoke from the wall 13, and to unfold the strips 130 of the fold.

Fold to Fold Connectors

According to another embodiment, the connectors 3 of a fold 131 are formed to cooperate with the connectors 3 of an adjacent fold, the connectors being preferably arranged opposite one another so as to be able to cooperate.

The connectors 3 can be arranged on the inside surface or outside surface of strips 130, as long as they do not pass through the wall 13 of the bag, so as not to compromise its seal.

This other embodiment can also be subject to several variants.

Figure 7B:
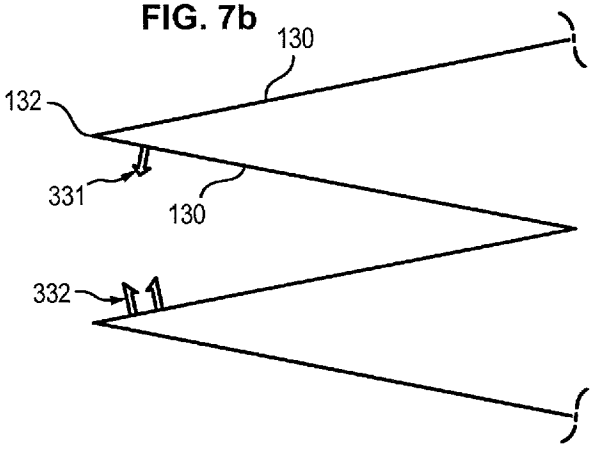
FIGS. 7*a* to 7*c* show variants of another embodiment of a bag.
Figure 7A:
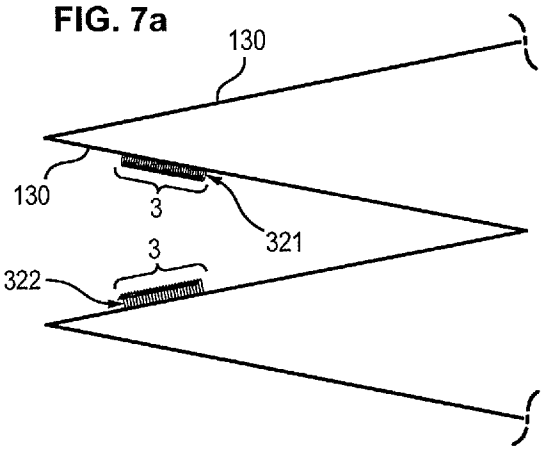

In FIG. 7*a*, the connectors 3 of two adjacent folds form a hook-and-pile type connection device; a connector 3 comprises an area 321 covered with loops forming the pile, and the other connector comprises an area 322 covered with hooks hooking into the loops of the opposite area 321.

In FIG. 7*b*, the connectors 3 of two adjacent folds form an elastic ratcheting device; a connector 3 can comprise a male element 331 and the other connector a female element 332 suitable for removably receiving the male element. According to a particular embodiment, the male element and the female element form a pushbutton.

Figure 7C:
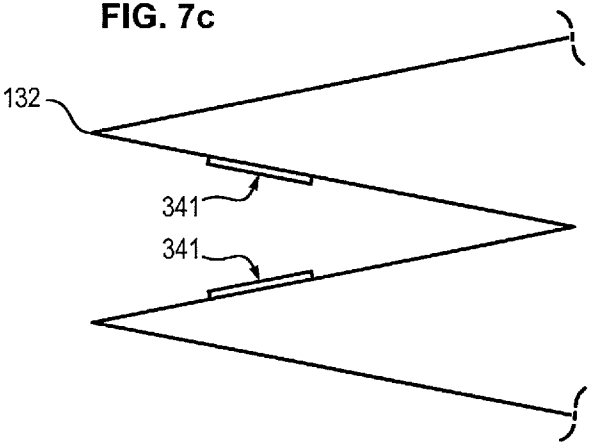

In FIG. 7*c*, the connectors 3 comprise adhesive strips 341 applied to the outside face of the lateral wall, on two strips 130 opposite one another, the adhesive strips being arranged opposite one another.

As can be seen in the figures, the folds are formed on the entire circumference of the lateral wall 13 so as not to impede communication from the enclosure 2 to the interior of the bag 1.

Now a fold can comprise a single connector 3, or a plurality distributed over the circumference of the lateral wall. Thus, according to an embodiment that can be seen for example in FIG. 5*b*, each fold 131 comprises a single connector 3. According to one alternative embodiment shown in FIG. 6, each fold 131 comprises several connectors 3, two connectors 3 for example.

Thus for example, the lateral wall 13 can be formed from two flaps 133 comprising lateral edges 134 and transverse edges 135, the flaps being connected edge to edge at least by their lateral edges and one transverse edge. The other transverse edges can be free to form the communication opening 12 of the bag. Alternatively, they can be welded together, and in this case the communication opening 12 can be made in one of the flaps.

In this case, the two connectors of a fold are advantageously made on one flap 133, advantageously equidistant from the lateral edges of the flap. The connectors then form two distinct alignments.

In the case where the connectors are yokes 30, the connection member 31 can comprise at least one first link 311 passing through openings of a first alignment of yokes, and at least one second passing through openings of a second alignment of yokes.

As a variant, it can also be provided that the yokes are applied to the two flaps 133, by being arranged on the entire circumference of the wall 13.

The variant embodiments of the connectors can of course be combined with variants regarding their number and their arrangement.

All the possible implementations proposed earlier allow the folds to be stiffened to hold them in the folded position and/or to connect the folds to one another temporarily, and to separate selectively one fold from the others when an additional length of bag is desired.

Figure 8:
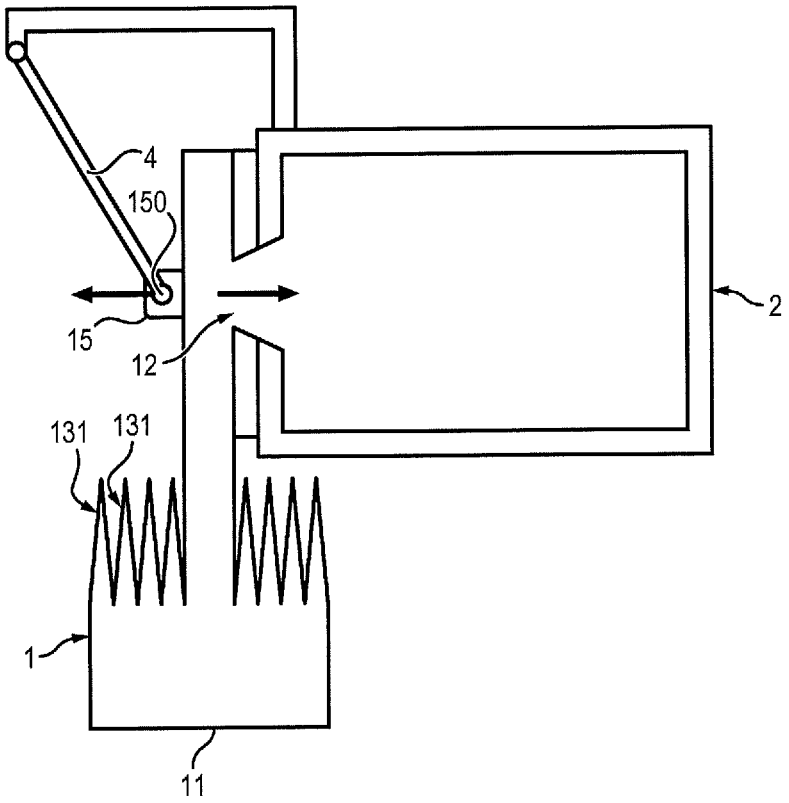
FIG. 8 illustrate a bag conforming to an embodiment of the invention, mounted on a contained enclosure.

Finally, with reference to FIG. 8, the bag 1 can also comprise at least one additional means of attachment 15, arranged on an outside surface of the lateral wall 13 of the bag, while advantageously being opposite the communication opening 12.

This additional means of attachment 15 can advantageously take the form of an additional yoke applied permanently to the wall, in other words non-peelably. This additional yoke comprises at least one portion protruding with respect to the lateral wall, so as to be able to be hooked to another element. Optionally, this portion can comprise a through opening 150 for passage of a link 4.

This means of attachment allows in particular gripping the wall 13 opposite the communication opening to hold it at a distance from the communication opening 12. In fact, in the case where the bag is in communication with the enclosure 2 and it is subjected to a pressure below the atmospheric pressure surrounding the enclosure, this pressure difference can tend to drive the bag toward the interior of the enclosure.

In FIG. 8, the fact of exerting a tension on the means of attachment 15 in a direction moving away from the communication opening 12 allows this displacement of the bag to be avoided. Optionally, the tension can be exerted on the means of attachment by a system connected to the enclosure itself (shown schematically in the figure by a pulley system). Thus, the enclosure being immobile, the tension exerted on the bag is constant and does not require any adjustment or intervention by an operator.

Shown in FIGS. 9*a* to 9*d* is a packaging method for components initially stored in the contained enclosure 2, in a bag 1 according to the foregoing description.

Figure 9B:
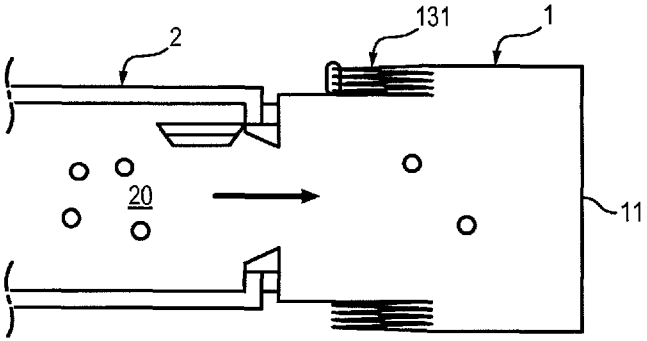
FIGS. 9*a* to 9*d* show the implementation of a packaging method for components with a bag conforming to an embodiment of the invention.
Figure 9D:
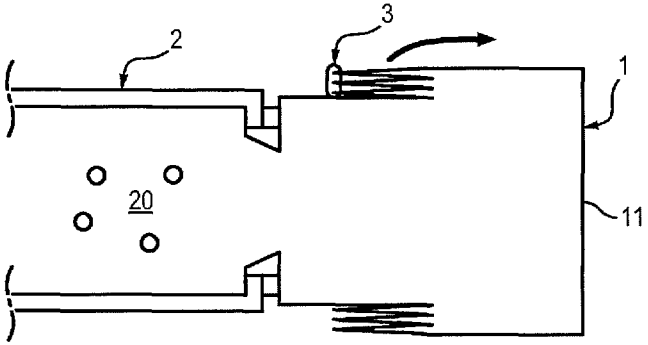
Figure 9A:
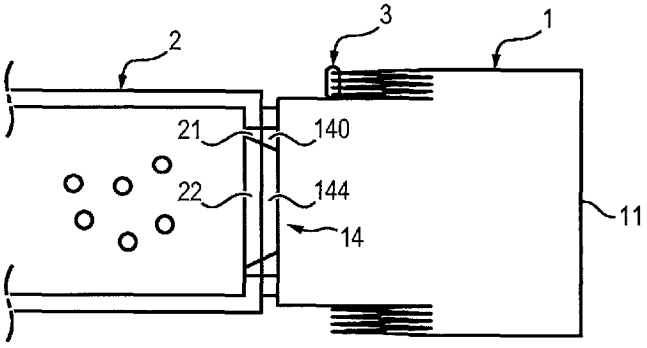

In FIG. 9*a*, a bag 1 is attached to the door 22 of the enclosure by its joining device 14, then, in FIG. 9*b*, the door 22 of the enclosure and the door 141 of the joining device of the bag are opened to put the inside space of the bag into communication with that of the bag.

An operator can then transfer components C contained in the enclosure toward the interior of the bag via the open communication between the enclosure and the bag.

Figure 9C:
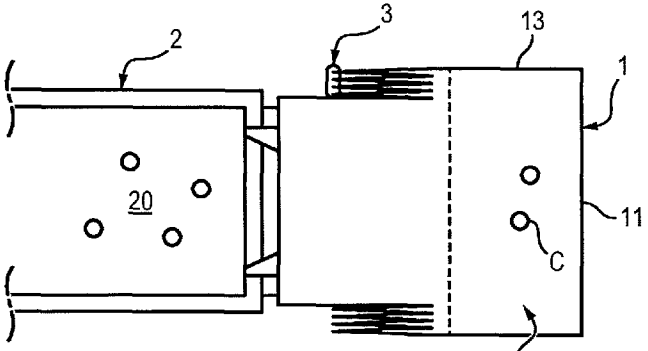

In FIG. 9*c*, a compartment 16 of the bag is closed, preferably by heat-welding, to sealingly isolate the components in the compartment 16. The compartment 16 can then be detached from the rest of the bag. A new bottom of the bag is formed by re-closing the wall, for example by heat-welding the wall closing the compartment 16.

Then, in FIG. 9*d*, a fold is detached from the other folds to obtain an additional bag space. The detached fold is preferably the first fold before the bottom 11 of the bag. This fold is unfolded to obtain an additional length of bag equal to the length of the two strips 130. Steps 9*c* to 9*d* can be reproduced with new components.

Thus a bag has been proposed which can be used for the successive packaging of several components contained in a contained enclosure, while holding excess storage length folded and held ergonomically and with little bulk. The need for a rigid support structure is eliminated, and obviously the quantity of waste as well as the requirements for cleaning or sterilization between two successive bags.

The invention claimed is:

1. A bag for sealably packaging components, comprising:
- a flexible body defining an inside space comprising:
- a communication opening,
- a lateral wall comprising a plurality of strips folded back against one another, and
- a joining device configured to selectively close or open the communication opening, and being formed to be mounted on an enclosure to allow sealed communication between an inside cavity of the enclosure and the inside space of the flexible body,
- wherein at least one fold formed by two strips opposite one another is detachably connected to at least one other fold by at least one yoke,
- wherein the bag further comprises at least one member for connecting the yokes corresponding to one or more folds,
- wherein each yoke comprises a portion permanently attached to the wall or integrated therewith, a detachable portion attached to the connection member, and a cutting line extending between the two portions.

2. The bag according to claim 1, wherein the at least one member includes a through opening created in each yoke, and at least one link formed to extend through the openings of the yokes.

3. The bag according to claim 1, further comprising a yoke applied to a flap of the lateral wall opposite the communication opening and including at least one protruding portion to allow the yoke to be gripped.

4. A packaging method for at least one component contained in a controlled-environment enclosure, comprising the steps of:
- bringing a bag according to claim 1 into sealed communication with the enclosure,
- bringing at least one component from the interior of the enclosure to the interior of the bag,
- closing a compartment of the bag comprising components, and
- detaching the first fold of the bag before the bottom from the other folds and unfolding said fold.

5. The packaging method according to claim 4, wherein the closure of the compartment is implemented by heat-welding the wall.

6. A bag for sealably packaging components, comprising:
- a flexible body defining an inside space comprising:
- a communication opening,
- a lateral wall comprising a plurality of strips folded back against one another, and
- a joining device configured to selectively close or open the communication opening, and being formed to be mounted on an enclosure to allow sealed communication between an inside cavity of the enclosure and the inside space of the flexible body,
- wherein at least one fold formed by two strips opposite one another is detachably connected to at least one other fold,
- wherein at least one fold comprises a connector suitable for cooperating with a connector of an adjacent fold,
- wherein the connectors of two adjacent folds comprise a ratcheting device comprising two components arranged respectively on outside surface of two strips, opposite one another.

7. The bag according to claim 6, further comprising a yoke applied to a flap of the lateral wall opposite the communication opening and including at least one protruding portion to allow the yoke to be gripped.

8. A packaging method for at least one component contained in a controlled-environment enclosure, comprising the steps of:
- bringing a bag according to claim 6 into sealed communication with the enclosure,
- bringing at least one component from the interior of the enclosure to the interior of the bag,
- closing a compartment of the bag comprising components, and
- detaching the first fold of the bag before the bottom from the other folds and unfolding said fold.

9. The packaging method according to claim 8, wherein the closure of the compartment is implemented by heat-welding the wall.

* * * * *